US005575278A

United States Patent [19]

Bonhomme et al.

[11] Patent Number: 5,575,278

[45] Date of Patent: Nov. 19, 1996

[54] INDIVIDUAL EQUIPMENT FOR PROTECTION AGAINST NBC ATTACKS

[75] Inventors: Jean-Phillipe Bonhomme, Viroflay; Eric Farin, Paris; Jean-Claude Urgel, Le Chesnay; Claude Fevrier, Magnanville, all of France

[73] Assignee: Intertechnique, Plaisir, France

[21] Appl. No.: 554,567

[22] Filed: Nov. 6, 1995

[30] Foreign Application Priority Data

Nov. 7, 1994 [FR] France ..... 94 13315

[51] Int. Cl.[6] ..... A62B 17/00

[52] U.S. Cl. ..... 128/201.29; 128/201.22; 2/6.2; 2/6.3; 2/439

[58] Field of Search ..... 128/201.29, 201.22, 128/201.23, 201.28; 2/6.2, 6.3, 10, 15, 427, 431, 439, 909

[56] References Cited

U.S. PATENT DOCUMENTS

| | | | |
|---|---|---|---|
| 3,438,060 | 4/1969 | Lobelle et al. | 2/6 |
| 3,668,705 | 6/1972 | Garbisch | 2/10 |
| 4,017,906 | 4/1977 | Bochynsky et al. | 2/10 |
| 4,091,469 | 5/1978 | Davidson | 2/410 |
| 4,315,335 | 2/1982 | Kennedy et al. | 2/424 |
| 4,622,696 | 11/1986 | Griffiths | 2/6.3 |
| 4,768,235 | 9/1988 | Webster | 2/205 |
| 4,825,878 | 5/1989 | Kuntz et al. | 128/857 |
| 5,181,506 | 1/1993 | Tardiff, Jr. et al. | 128/201.22 |

FOREIGN PATENT DOCUMENTS

| | | | |
|---|---|---|---|
| 0105813 | 4/1984 | European Pat. Off. . | |
| 0259908 | 3/1988 | European Pat. Off. . | |
| 0371858 | 6/1990 | European Pat. Off. . | |
| 647933 | 7/1937 | Germany | 2/10 |
| 1958730 | 5/1971 | Germany | 128/201.29 |
| 614379 | 11/1979 | Switzerland . | |

OTHER PUBLICATIONS

Brochure, Rite–Whitecap Personal Environmental Systems. Feb. 1960.

*Primary Examiner*—V. Millen
*Assistant Examiner*—Eric P. Raciti
*Attorney, Agent, or Firm*—Larson and Taylor

[57] ABSTRACT

The equipment is usable by a person exposed to NBC threats. It has a helmet, a face-cover provided with fastenings for connection to the helmet and with a coupling for a breathing gas feed or ventilation hose. A flexible envelope extends the helmet and the face-cover downwards. For providing sealed connection between the helmet, the face-cover, and the envelope, a hoop is fixed to the helmet in permanent or removable manner. It projects from the base of the helmet forwards. The top edge of the hoop receives the face-cover and the lower edge hoop receives the envelope in sealed manner.

11 Claims, 3 Drawing Sheets

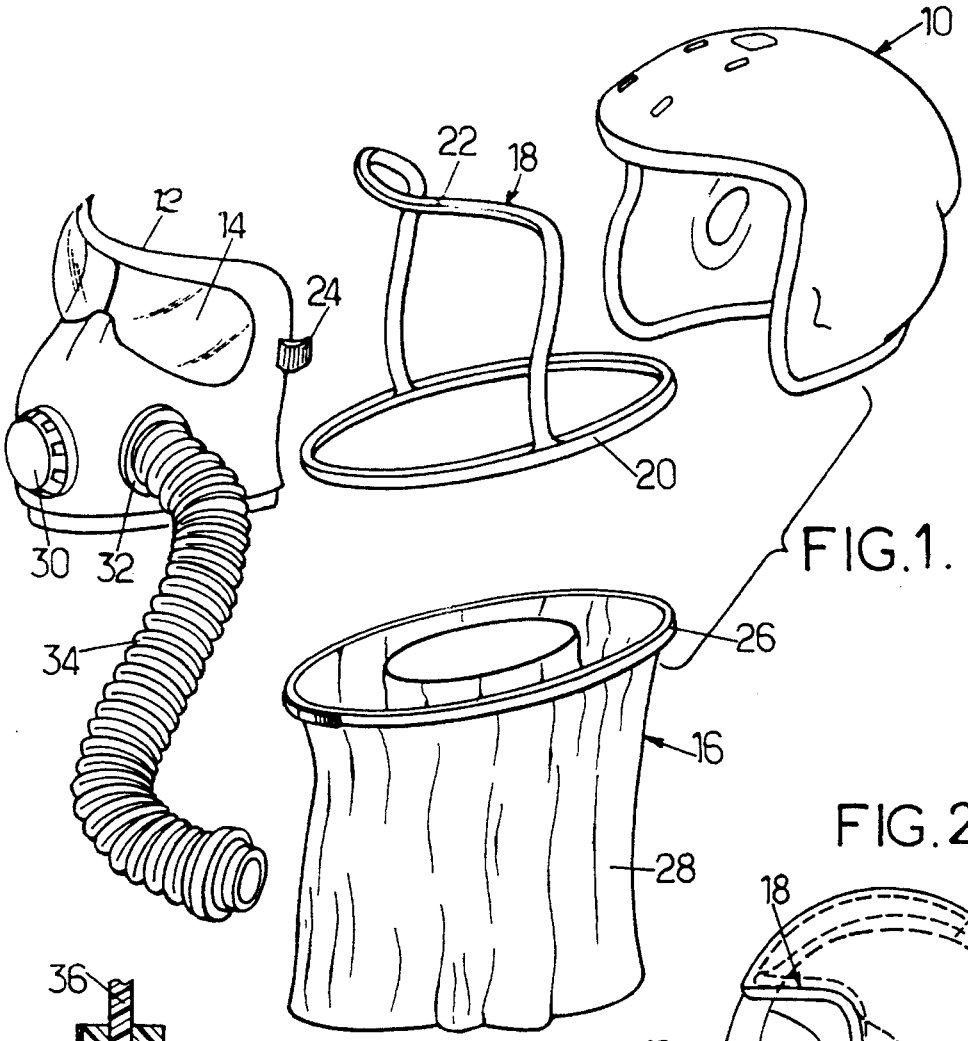
FIG.1.
FIG.2.
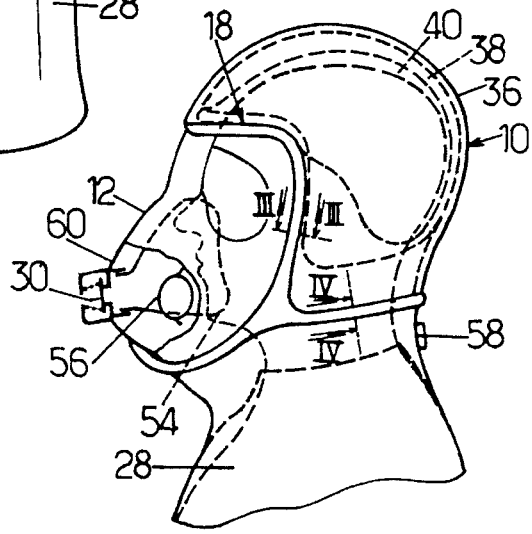
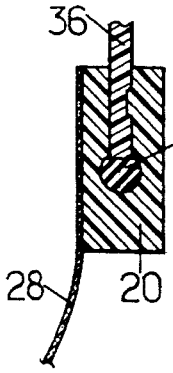
FIG.4.
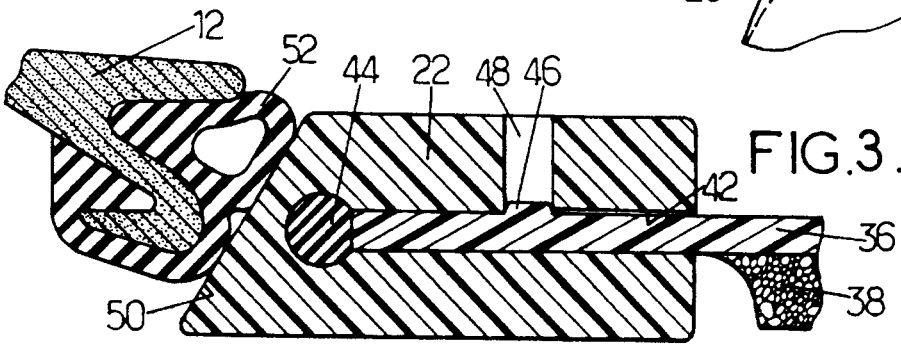
FIG.3.

FIG. 7.
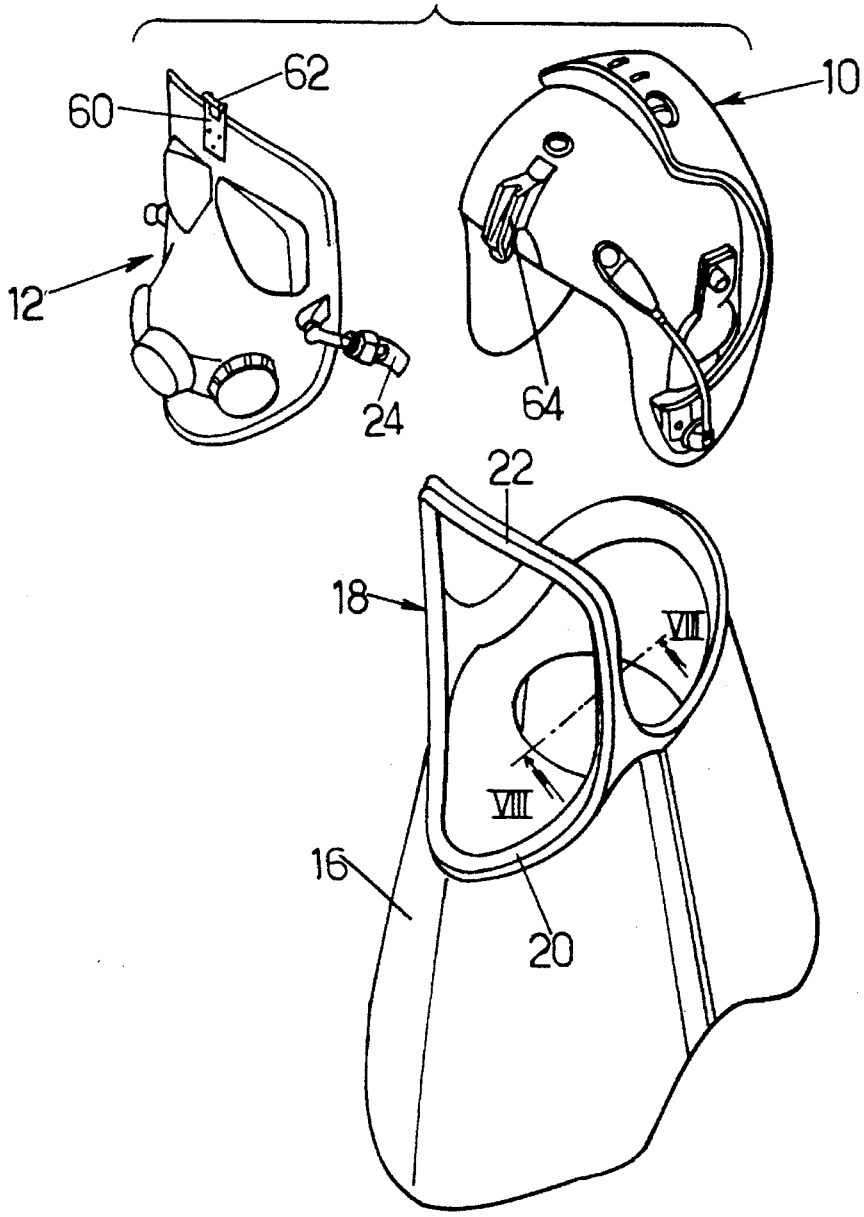
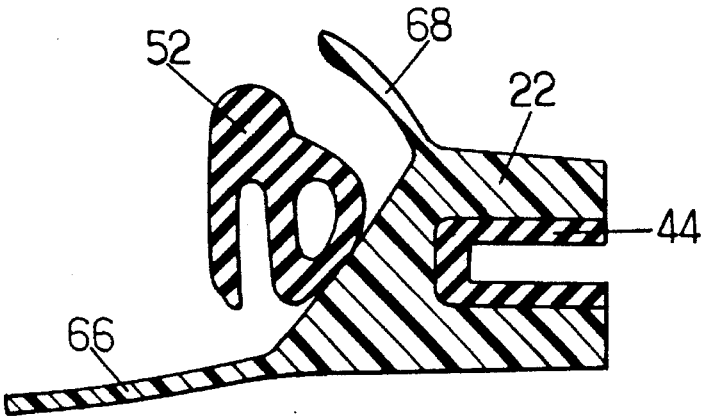
FIG. 8.

INDIVIDUAL EQUIPMENT FOR PROTECTION AGAINST NBC ATTACKS

BACKGROUND OF THE INVENTION

The present invention relates to individual equipment for protecting personnel exposed to so-called NBC threats (nuclear, bacteriological, or chemical contamination).

Such individual equipment generally comprises a helmet, a full face cover provided with fastenings for fixing it to the helmet and with a coupling for a breathing gas feed or ventilation hose, and a flexible envelope, often called a neck gasket, for extending the helmet and the face-cover downwards, together with airtight connection means between the helmet, the face-cover, and the envelope. The helmet provides protection against puncture and shock, and also serves as a support for various items such as earphones and a transparent visor.

That structure makes it possible for personnel to use only the helmet when performing a mission that does not include any NBC threat. This avoids the discomfort of items of equipment that envelop the face and the neck completely.

However, when personnel is informed prior to a mission that there is a risk of an NBC attack, then the envelope is installed on the helmet. When the actual presence of a threat is indicated, either by sensor means carried by a vehicle occupied by personnel, or by transmitted information, then the user dons the face cover and secures it to the helmet, after switching on the ventilation system that feeds filtered air or the system for feeding breathing gas.

The first situation arises in particular in helicopters that operate at low altitude and that are therefore not fitted with a pressurized oxygen source, and also on military transport planes operating at moderate altitude.

The structure of the equipment as three separate items (helmet, face-cover, and envelope) suffers from the point of view of gastightness from the drawback of having a point of interconnection between all three items. It is difficult to provide the amount of sealing necessary for protection purposes at this "triple" point.

SUMMARY OF THE INVENTION

An object of the present invention is to avoid that drawback and to provide individual protection equipment in which there is no such triple point, while making it possible to use the helmet on its own, or with the envelope, while the face-cover necessary for NBC protection is added only when needed.

To this end, the invention provides, in particular, equipment in which the air tight connection means comprise at least one hoop fixed to the helmet in permanent or removable manner, projecting from the base of the helmet forwards, an upper edge of the hoop being designed to receive the face-cover, and the hoop receiving the envelope sealingly. In a particular embodiment, the lower edge is designed to receive in sealed manner a gasket-forming ring belonging to the envelope.

The term "envelope" should be understood broadly: the envelope is generally constituted by a neck gasket surrounding the neck of the pilot so as to provide gas sealing, and it is covered by a bib to provide liquid sealing. The term "ring" must also be understood broadly as covering in general terms any gasket whose periphery is uninterrupted, in particular gaskets which are circular at rest.

In a first embodiment, the hoop is permanently fixed to the helmet and is approximately semicircular in shape. It is merged with the base of the helmet. It may be made of a material that is flexible so as to fold when pressed against an obstacle by movements of the head while the pilot is not wearing a face-cover. Under such circumstances, the envelope includes a closed ring designed to fit both to the hoop and to the lower edge of the helmet.

In another embodiment, the hoop is removable and made in a single piece, having a branch constituting a closed lower loop for receiving the envelope and a transverse branch having one side designed to be fitted to the shell of the helmet and its other side designed to receive the face-cover.

To reduce the discomfort due to wearing the equipment, the face-cover and the hoop may be designed so that a gap remains between the head and the unit comprising theface-cover and the shell of the helmet. The face-cover contains a facemask covering the mouth and nose and defining a breathing volume leading directly to the outside via a breathe-out non-return valve and fed from the space between the face-cover and the facemask via a breathe-in valve between the air feed and the facemask. This ensures that water vapor contained in exhaled air cannot invade this space. Circulation in the helmet padding, the face-cover, and the envelope as a whole can be organized to sweep the scalp and the top of the neck, and also to de-mist the visor.

The invention will be better understood on reading the following description of particular embodiments, given as non-limiting examples. The description refers to the accompanying drawings.

BRIEF DESCRIPTION OF THE DRAWINGS

FIG. 1 is an exploded view showing the general structure of the equipment constituting a first embodiment;

FIG. 2 is a schemetic elevational view partially in cross-section, showing one possible structure of the face-cover;

FIGS. 3 and 4 are cross-sections respectively on lines III—III and IV—IV of FIG. 2;

FIG. 7 is an exploded view showing still another embodiment of the invention; and FIG. 8 is a cross-sectional view on an enlarged scale, at the level of line VIII—VIII on FIG. 7.

DETAILED DESCRIPTION OF PREFERRED EMBODIMENTS

Figure 5:
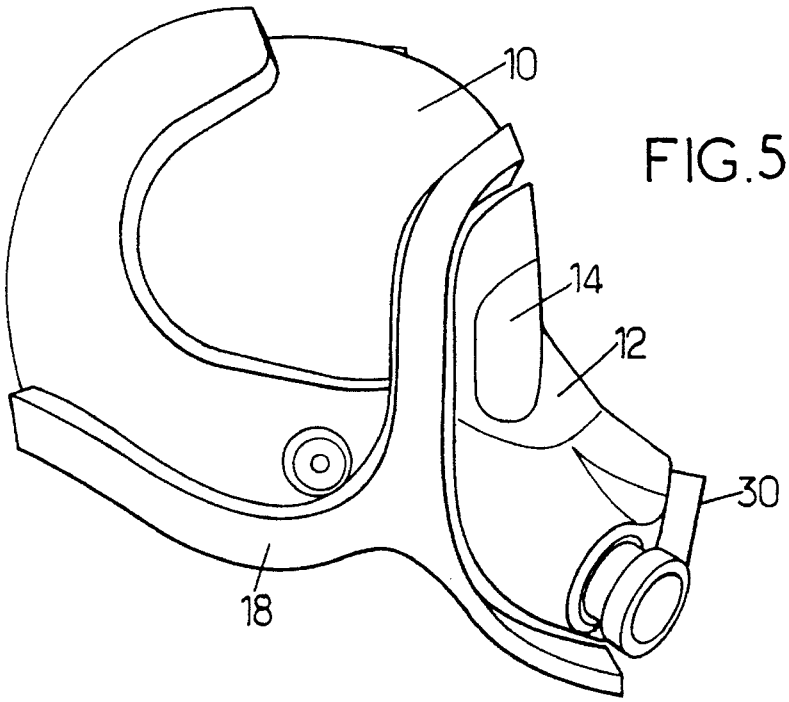
FIG. 5 is an elevation view of the helmet, the hoop, and the face-cover of equipment having the structure shown in FIGS. 1 and 2 (the envelope not being shown)

The equipment shown diagrammatically in FIG. 1 is designed to be fed with atmospheric air via a protection filter (not shown) and optionally via a blower. The equipment comprises a helmet 10, a face-cover 12 having a transparent visor 14 and an envelope 16. The face-cover has a breathe-out valve 30, an endpiece for coupling to a flexible hose 34 for feeding air, and optionally a drinking liquid feed endpiece (not shown in FIG. 1), placed symmetrically to the endpiece 32 about the vertical midplane of the face-cover. In addition, according to the invention, the equipment includes a hoop 18 designed to allow the helmet 10, the face-cover 12, and the envelope 16 to be connected together in air-tight manner.

In the example shown in FIG. 1, the hoop 18 is removable and constitutes a single piece. It comprises a lower branch 20 in the form of a closed loop that is designed to receive the envelope 16, and a U-shaped transverse branch 22 designed to have one side fitted to the helmet 10 and the other to the face-cover.

For missions during which no NBC threat is expected, the person to be protected wears the helmet only.

If on the other hand there is a potential NBC threat, then the person to be protected, e.g. a helicopter pilot, fits the envelope 16 and the hoop 18 to the helmet 10 before he dons the helmet.

If an NBC threat is indicated by sensors or by telecommunication, the pilot puts on the face-cover 12 which is provided with fastenings 24 suitable for pressing it against the hoop 18.

As a result, the various sealing junctions required do not include mutual connections having a triple point where leaks are prone to occur.

In the embodiment shown in FIG. 1, the envelope 16 comprises a gasket 26 having a flexible extension projecting from its base and surrounding the neck. The gasket is semi-rigid, having a shape that corresponds to that of the lower branch 20 of the hoop, and a bib of impermeable cloth 28 is sealingly and permanently connected to the gasket 26.

In another possible structure, the hoop 18 and the envelope 16 are permanently connected together.

FIGS. 2 to 4 show one particular possible structure for the various components described above. In these figures, items already shown in FIG. 1 are designated by the same reference numerals.

The helmet 10 as shown in FIG. 2 conventionally includes a rigid shell 36 permanently lined over a major portion of its inside surface with permanent antishock padding 38. In addition, the helmet, as shown, has personalized internal padding 40 that may be made of expanded material that has been molded directly on the head of the wearer, thereby making it possible to give the helmet an accurately defined position on the head. This structure is particularly advantageous when helmet sights are provided, since the helmet must then have a well-determined position on the head. The personalized internal padding may include grooves or openings for passing ventilation air.

The lower branch of the hoop shown in FIG. 2 is warped in shape, projecting downwards in front of the second branch, so as to fit properly to a face-cover 12 that contains a breathing mask 54 described in greater detail below.

The sealing means interposed between the branch 22 of the hoop and both the helmet 10 and the face-cover 12 may have the structure shown in FIG. 3. The face of the hoop facing the helmet has a groove 42 with parallel faces except for an enlarged end designed to receive a O-ring gasket 44. The hoop may be fixed to the helmet by various means. In the example shown in FIG. 3, the hoop is snap-fastened to the shell 36 of the helmet by engaging studs 46 carried by the shell or the hoop in recesses 48 formed in the hoop or the shell. When the shell and the hoop have been secured together, the end edge of the shell compresses the O-ring gasket 44.

The face 50 of the hoop facing the face-cover 12 is advantageously inclined backwards and outwards. A gasket 52 whose cross-section may be as shown diagrammatically in FIG. 3, for example, is engaged on the back of the face-cover 12. When the face-cover is pulled towards the helmet by the fastenings 24, the gasket 52 is compressed against the sloping edges and provides sealing.

In the example shown in FIG. 4, the envelope 16 is permanently secured to the lower branch 20 of the hoop, e.g. by adhesive, and the connection between said bottom branch of the hoop and the shell 36 of the helmet is of the same kind as the connection between the branch 22 and the shell.

In the example shown in FIG. 2, the face-cover proper 12 is separated from an oro-nasal space by a mask 54. This mask opens out directly into the breathe-out valve 30, so that air laden with water vapor and carbon dioxide as breathed out by the wearer is exhausted directly to the atmosphere and cannot invade the remainder of the face-cover. The breathe-out valve 30 may be covered or protected by a special cap so as to provide better protection against ingress of pollutants. The mask 54 also includes a breathe-in valve 56 designed to allow fresh air to pass into the mask as conveyed through the endpiece 32 in the face-cover.

The valve 56 may be connected to a ventilation strip for ventilating the face by circulation of air admitted into the mask.

The helmet 10 and the envelope 16 may be designed so that ventilation is also provided over the entire head, and in particular the scalp. To this end, channels are formed in the inside face of the padding 40 and they receive ambient or conditioned air as fed via the endpiece 32. To ensure that air circulates through these channels, the rear portion of the envelope, above the portion that provides sealing with the neck, may be provided with an exhaust valve 58 exhausting to the atmosphere that fraction of the air flow which is not breathed in through the mask.

Securing the face-cover to the helmet in a position where it is to be applied against the wearer's face prevents it from moving until a sealing lip of the facemask 54 presses against the face. Consequently, it is desirable to personalize each face-cover and mask assembly. This may be done by making use of the connections between the mask and the breathe-out valve 30, the liquid feed point, and an extension of the endpiece 32 all of which can be used as adjustable bearing points. For example, the connection between the mask and the breathe-out valve 30 may be constituted by a set of two lengths of tube 60 capable of sliding one in the other and then of being locked one relative to the other once they are in the appropriate position. The other two connections can be similar.

The helmet, the face-cover, and the hoop may have the shape shown in FIG. 5. The hoop is constituted as a single molded piece which is warped in shape, having a lower branch with a drooping front portion so as to leave room required for a face-cover that has a high amount of downward extension, thereby clearing the field of view of the user. The breathe-out valve 30 is in front. The liquid feed connection and the coupling endpiece are placed on either side, pointing downwards and outwards.

Figure 6:
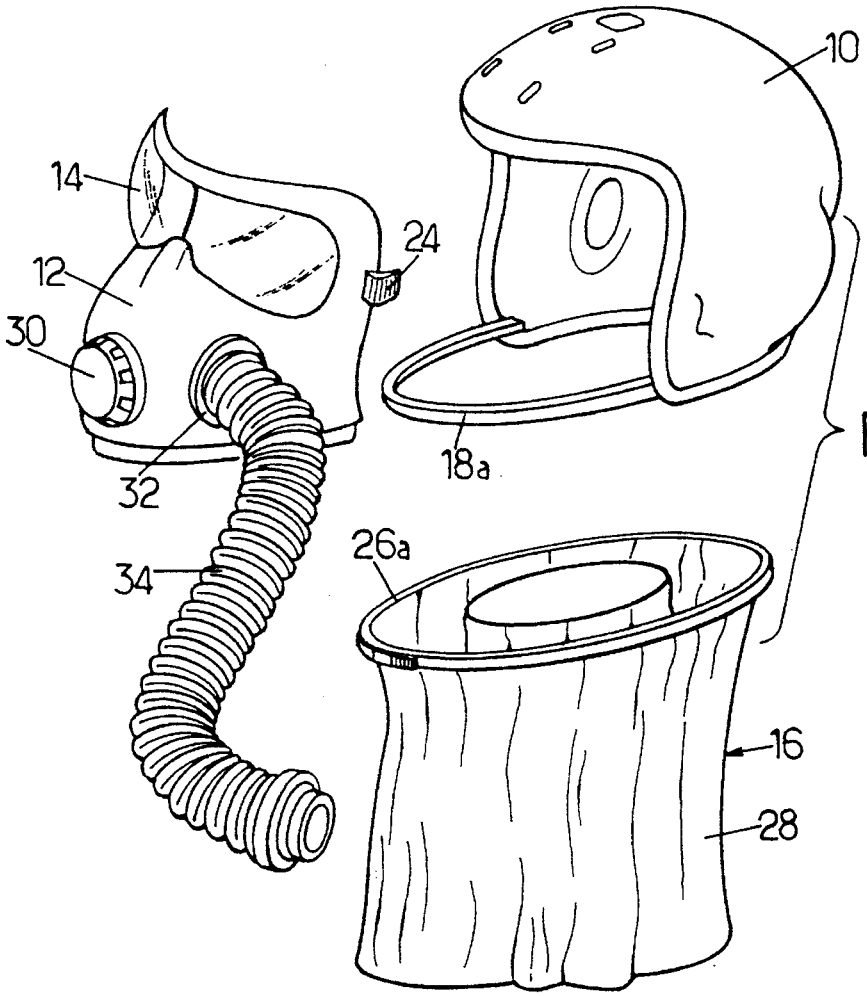
FIG. 6 is a view similar to FIG. 1 showing another embodiment.

In the embodiment of the invention shown in FIG. 6, the hoop is reduced to a half-branch **18*a* in the form of a horseshoe which is permanently sealingly secured to the shell of the helmet, in line with the bottom edge of the shell. In this case, the envelope includes a ring 26 designed to be fixed in sealed manner to the helmet and to the hoop at the beginning of a mission for which there is a risk of NBC contamination. The sealing and connection means between the ring of the envelope and the hoop-helmet assembly may be of the kind shown in FIG. 4**.

In practice, the hoop **18*a* will generally be of a shape that dips down forwardly, comparable to that shown in FIGS. 2 and 3**. To ensure that the hoop does not impede downwards head movements of the pilot, when it is not carrying a face-cover, the hoop may be made of a material that is flexible, and typically synthetic material.

Referring to FIGS. 7 and 8, still another embodiment of the invention again comprises a helmet 10 and a hoop 18 permanently attached to an envelope 16. In FIGS. 7 and 8, the elements corresponding to those of the preceding Figures are again designated by the same reference number.

As shown on FIG. 7, the face-cover 12 is arranged for being easily done. For that purpose, it includes a yoke 60 projecting upwardly and having a transverse pin 62. The helmet 10 has a fork 64 arranged for receiving the pin when the face-cover 12 is slid upwardly along the upper portion of the transverse branch 22. When the face-cover is properly located, it may be secured to the helmet by fasteners 24, preferably having an adjustable length.

Referring to FIG. 8, the upper portion of the transverse branch 22 has lateral lips 66 and 68, which may be omitted in the lower portion. The seal 52 may have various shapes and for instance the portion at the right of FIG. 8 may consist of a flexible arcuate lip rather than a closed ring.

Various other embodiments of the invention are possible and the equipment may be adapted for use by soldiers, with a lighter helmet and an air-filtering system.

We claim:

1. Individual protection equipment for use by a person exposed to NBC threats, comprising:

a helmet;

a face-cover provided with fastenings for connection with the helmet and provided with a coupling for a breathing gas feed;

a flexible envelope extending from the helmet and the face-cover downwards; and means for providing a sealed connection between the helmet, the face-cover and the envelope;

wherein said means for providing the sealed connection comprises a hoop sealingly securely secured to the helmet and projecting forwardly from a base of said helmet, said hoop having an upper edge and a lower edge and wherein said upper edge is constructed to have a gas tight connection with said face-cover while said lower edge is constructed to have a gas-tight connection with said envelope, whereby said helmet, face-cover and flexible envelope define a gas-tight volume in front of and around the head of the person wearing the individual protection equipment.

2. Equipment according to claim 1, wherein said hoop is permanently secured to the helmet, is approximately semi-circular in shape, and merges with the base of the helmet.

3. Equipment according to claim 2, wherein the hoop is made of flexible material.

4. Equipment according to claim 2, wherein the envelope is provided with a ring for sealed connection to the base of the helmet and to the hoop.

5. Individual protection equipment for use by a person exposed to NBC threats, comprising:

a helmet;

a face-cover provided with fastenings for connection with the helmet and provided with a coupling for a breathing gas feed;

a flexible envelope extending from the helmet and the face-cover downwards; and means for providing a sealed connection between the helmet, the face-cover, and the envelope;

wherein said means for providing the sealed connection comprises a hoop projecting forwardly from the base of said helmet, said hoop having an upper edge and a lower edge, wherein said upper edge is constructed to sealingly receive said face-cover while said lower edge is constructed to have a gas-tight connection with said envelope, whereby said helmet, face-cover and flexible envelope define a gas-tight volume in front of the person wearing the individual protection equipment, and wherein said hoop is removably connected to said helmet and made in a single piece, having a lower branch constituting a closed bottom loop for receiving the envelope and a transverse branch having one side constructed to fit on a shell of the helmet and an opposed side constructed to receive a gasket of the face-cover.

6. Equipment according to claim 5, wherein said envelope is permanently fixed to the lower branch of the hoop.

7. Equipment according to claim 5, wherein said envelope has a ring sealingly connectable to the lower branch and permanently secured to a flexible portion of the envelope.

8. Individual protection equipment for use by a person exposed to NBC threats, comprising:

a helmet;

a face-cover provided with fastenings for connection with the helmet and provided with a coupling for a breathing gas feed;

a flexible envelope extending from the helmet and the face-cover downwards; and means for providing a sealed connection between the helmet, the face-cover, and the envelope;

wherein said means for providing the sealed connection comprises a hoop secured to the helmet and projecting forwardly from the base of said helmet, said hoop having an upper edge and a lower edge and wherein said upper edge is constructed to sealingly receive said face-cover while said lower edge is constructed to have a gas-tight connection with said envelope, whereby said helmet, face-cover and flexible envelope define a gas-tight volume in front of the person wearing the individual protection equipment, and wherein a unit is formed by said face-cover and said hoop which are constructed to leave a space between the head of the user and said unit;

said equipment further comprising a face mask located within said face-cover and defining a breathing cavity, a breath-out non-return valve communicating said breathing cavity directly to the outside, and a breathing non-return valve communicating said coupling and breathing cavity.

9. Equipment according to claim 8, having means for adjusting the mask inside the face-cover.

10. Equipment according to claim 9, wherein the mask is fixed to the face-cover by a connection to the breathe-out valve carried by the face-cover, a junction with an air inlet end fitting leading to the face-cover, and a junction between the face-cover and a liquid feed connection.

11. Equipment according to claim 8, wherein said helmet has an internal padding formed with grooves and wherein said breathing non-return valve is connected to said grooves for ventilation.

* * * * *